US009310825B2

(12) United States Patent
Bohannon

(10) Patent No.: US 9,310,825 B2
(45) Date of Patent: Apr. 12, 2016

(54) STABLE VOLTAGE REFERENCE CIRCUITS WITH COMPENSATION FOR NON-NEGLIGIBLE INPUT CURRENT AND METHODS THEREOF

(75) Inventor: Eric Bohannon, Rochester, NY (US)

(73) Assignee: Rochester Institute of Technology, Rochester, NY (US)

( * ) Notice: Subject to any disclaimer, the term of this patent is extended or adjusted under 35 U.S.C. 154(b) by 0 days.

(21) Appl. No.: 12/910,556

(22) Filed: Oct. 22, 2010

(65) Prior Publication Data

US 2011/0148389 A1 Jun. 23, 2011

Related U.S. Application Data

(60) Provisional application No. 61/279,650, filed on Oct. 23, 2009.

(51) Int. Cl.
*G05F 3/16* (2006.01)
*G05F 3/30* (2006.01)

(52) U.S. Cl.
CPC ..... *G05F 3/30* (2013.01)

(58) Field of Classification Search
USPC ..... 327/513, 538–543; 323/311, 312, 313, 323/314, 315, 316, 317
See application file for complete search history.

(56) References Cited

U.S. PATENT DOCUMENTS 5,789,980 A * 8/1998 Nagata et al. ..... 330/253
6,081,131 A * 6/2000 Ishii ..... 326/68
6,160,391 A 12/2000 Banba
6,501,256 B1 12/2002 Jaussi et al.
6,531,857 B2 3/2003 Ju
6,563,371 B2 5/2003 Buckley, III et al.
6,677,808 B1 1/2004 Sean et al.
6,744,304 B2 * 6/2004 Egerer et al. ..... 327/540
6,788,041 B2 9/2004 Gheorghe et al.
6,906,581 B2 6/2005 Kang et al.
6,930,538 B2 8/2005 Chatal
6,937,099 B2 * 8/2005 Kirby ..... 330/253
7,033,072 B2 * 4/2006 Aota et al. ..... 374/178
7,053,597 B2 * 5/2006 Lin et al. ..... 323/316
7,078,958 B2 7/2006 Gower et al.
7,113,025 B2 9/2006 Washburn
7,166,994 B2 * 1/2007 Lee et al. ..... 323/313
7,170,274 B2 1/2007 Mukherjee et al.
7,411,380 B2 * 8/2008 Chang et al. ..... 323/314
7,429,854 B2 * 9/2008 Kimura ..... 323/315
7,514,987 B2 4/2009 Lin
7,535,285 B2 5/2009 Colman
7,622,906 B2 11/2009 Kushima et al.

(Continued)

*Primary Examiner* — Nguyen Tran
(74) *Attorney, Agent, or Firm* — Joseph M. Noto; Bond, Schoeneck & King PLLC

(57) ABSTRACT

A voltage reference circuit includes three or more current mirrors, an operational amplifier, a voltage buffer, two or more diodes, and one or more resistors. The operational amplifier has two inputs separately coupled to an output of two of the three or more current mirrors and an output coupled to the three current mirrors. The voltage buffer has an input coupled to an output of the other one of the three or more current mirrors and another input coupled to an output of the voltage buffer. Each of the diodes is coupled between the output of the two of the three or more current mirrors and one of ground and a negative supply. The one or more resistors are coupled to an output of one or more of the three or more current mirrors to tune effects of input current and establish a first set absolute voltage and temperature coefficient on a voltage reference.

23 Claims, 10 Drawing Sheets

(56) References Cited

U.S. PATENT DOCUMENTS

| | | | | |
|---|---|---|---|---|
| 7,626,374 | B2 | 12/2009 | Haiplik | |
| 7,630,267 | B2 * | 12/2009 | Chen | 365/211 |
| 7,633,330 | B2 | 12/2009 | Ogiwara et al. | |
| 8,228,053 | B2 * | 7/2012 | Stellberger et al. | 323/313 |
| 2006/0186865 | A1 * | 8/2006 | Placa et al. | 323/273 |
| 2007/0200546 | A1 * | 8/2007 | Logiudice et al. | 323/316 |
| 2008/0129272 | A1 * | 6/2008 | Kimura | 323/315 |

* cited by examiner

STABLE VOLTAGE REFERENCE CIRCUITS WITH COMPENSATION FOR NON-NEGLIGIBLE INPUT CURRENT AND METHODS THEREOF

This application claims the benefit of U.S. Provisional patent application Ser. No. 61/279,650, filed Oct. 23, 2009, which is hereby incorporated by reference in its entirety.

FIELD

This technology generally relates to voltage reference circuits and, more particularly, to stable voltage reference circuits with compensation for non-negligible input current and methods thereof.

BACKGROUND

A low voltage bandgap reference circuit is illustrated and described in U.S. Pat. No. 7,113,025, which is herein incorporated by reference in its entirety. More specifically, this voltage reference circuit includes a proportional to absolute temperature (PTAT) voltage generating means that generates a PTAT voltage and a complementary to absolute temperature (CTAT) voltage generating means generates a CTAT voltage. Additionally, this voltage reference circuit includes a temperature coefficient determining means that interconnects the PTAT voltage generating means and the CTAT voltage generating means. With this voltage reference circuit, a reference voltage approaching that of a forward-biased diode can be generated without the disadvantages of a fractional $V_{BE}$ approach.

However, this reference voltage circuit assumes a negligible device input current. This assumption of a negligible input current was consistent with the properties of the MOSFETs with thicker gate oxides at the time of U.S. Pat. No. 7,113,025, but no longer holds for all cases. For example, non-negligible input current can flow into or out of the gate terminal of metal oxide semiconductor field effect transistors (MOSFETs) with very thin gate oxides and also into or out of the base terminal of bipolar junction transistors (BJTs). This non-negligible input current can cause imbalance and unpredictability to the circuits that make up the voltage reference. This could negatively affect the characteristics of the output voltage. This non-negligible input current also may have a temperature coefficient that could affect the output voltage of the voltage reference circuit.

SUMMARY

A voltage reference circuit includes three or more current mirrors, an operational amplifier, a voltage buffer, two or more diodes, and one or more resistors. The operational amplifier has two inputs separately coupled to an output of two of the three or more current mirrors and an output coupled to the inputs of the three or current mirrors. The voltage buffer has an input coupled to an output of the other one of the three or more current mirrors and another input coupled to an output of the voltage buffer. Each of the diodes is coupled between the output of the two of the three or more current mirrors and one of ground and a negative supply. The one or more resistors are coupled to an output of one or more of the three or more current mirrors to tune effects of input current and establish a first set absolute voltage and temperature coefficient on a voltage reference.

A method of making a voltage reference circuit includes providing three or more current mirrors. Two inputs of an operational amplifier are separately coupled to an output of two of the three or more current mirrors and an output of the operational amplifier is coupled to the inputs of the three current mirrors. An input of a voltage buffer is coupled to an output of the other one of the three or more current mirrors and another input of the voltage buffer is coupled to an output of the voltage buffer. Each of two or more diodes is separately coupled between the output of the two of the three or more current mirrors and one of ground and a negative supply. One or more resistors are coupled to an output of one or more of the three or more current mirrors to tune effects of input current and establish a first set absolute voltage and temperature coefficient on a voltage reference.

This technology provides a number of advantages including providing stable voltage reference circuits and methods with compensation for non-negligible input current flowing into or out of input terminals to transistors that could cause imbalance to current mirrors or amplifiers and affect the characteristics of the output voltage. With this technology, input currents are balanced to ensure that the transistors that make up the voltage reference circuit drive similar areas and have similar voltages applied to their terminals. Additionally, with this technology transistors which make up the voltage reference circuit are sized to minimize some of the negative effects of input current. For example, transistor sizing is chosen to balance the output current to input current ratio which is an indicator of the relative effect of input current on the voltage reference.

DETAILED DESCRIPTION

Figure 1:
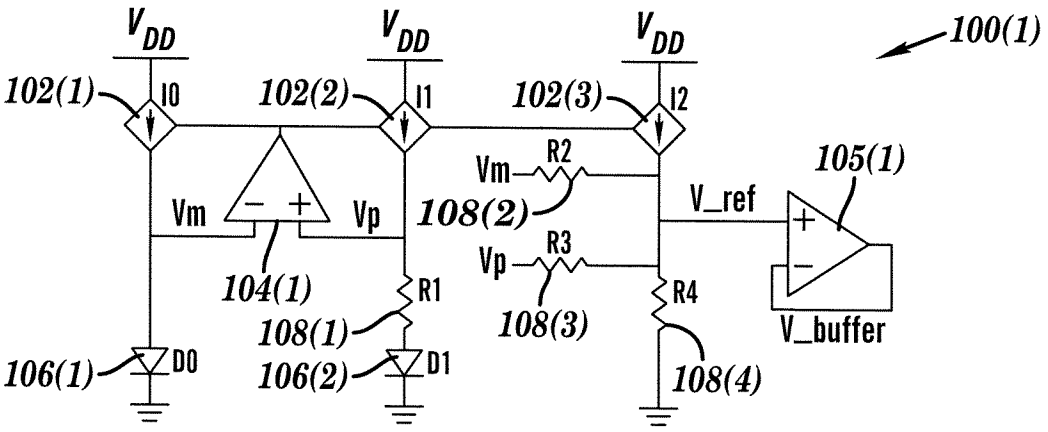
FIG. 1 is a partial block and partial circuit diagram of an exemplary stable voltage reference circuit with compensation for non-negligible input current.

An exemplary stable voltage reference circuit 100(1) with compensation for non-negligible input current is illustrated in FIG. 1. The exemplary voltage reference circuit 100(1) includes three current mirrors 102(1)-102(3), operational amplifier 104(1), voltage buffer 105(1), diodes 106(1)-106(2), and tuning resistors 108(1)-108(4), although the circuit can have other numbers and types of systems, devices, and/or elements in other configurations. Other exemplary embodiments of voltage reference circuits 100(2)-100(7) are illustrated and described with reference to FIGS. 2-5 and the various modifications can be used in a variety of other different combinations in these and other voltage reference circuits. This technology provides a number of advantages including providing stable voltage reference circuits with compensation for non-negligible input current flowing into or out of input terminals to transistors and methods thereof.

In the illustrative examples discussed herein, current that flows into or out of the input terminal of a transistor is referred to as input current herein, but it should be understood that a polarity of this input current could be positive or negative. Examples of this type of input current include gate current in a thin gate MOSFET and base current in a BJT. Non-negligible input current means any current that could flow through the gate terminal of a MOSFET or the base terminal of a BJT. Common examples of MOSFET gate current include direct tunneling, Fowler-Nordheim tunneling, and hot electrons. BJTs, by nature of their fabrication, have some associated base current. In these examples, non-negligible input current is an input current above that must be compensated for, although other thresholds for non-negligible input current could be used.

Referring more specifically to FIG. 1, an exemplary stable voltage reference circuit 100(1) with compensation for non-negligible input current is illustrated. The voltage reference circuit 100(1) includes the three current mirrors 102(1)-102(3) (also identified as I0, I1, and I2) that help form the voltage reference, although other numbers of current mirrors can be used. In this example, current mirror 102(2) is coupled between a voltage source $V_{DD}$ and an anode of a diode 106(1) (also identified as D0) and the inverting input terminal Vm to the operational amplifier 104(1). Current mirror 102(2) is coupled between the voltage source $V_{DD}$ and a lead of resistor 108(1) (also identified as R1) and a positive input terminal Vm to the operational amplifier 104(1). Current mirror 102(3) is coupled between the voltage source $V_{DD}$ and one lead for each of resistors 108(2)-108(4) (also identified as R2, R3, and R4, respectively) and a non-inverting input terminal of a voltage buffer 105(1). A cathode of diode 106(1) and a cathode of diode 106(2) are each coupled to ground, although here and in other examples where ground is discuss other fixed reference levels other than ground, such as a fixed negative supply voltage or level could be used. The other lead of resistor 108(2) is coupled to terminal Vm, the other lead of resistor 108(3) is coupled to terminal Vp, and the other lead of resistor 108(4) is coupled to ground. An inverting input terminal of the voltage buffer 105(1) is coupled to an output of the voltage buffer 105(1).

Figure 2:
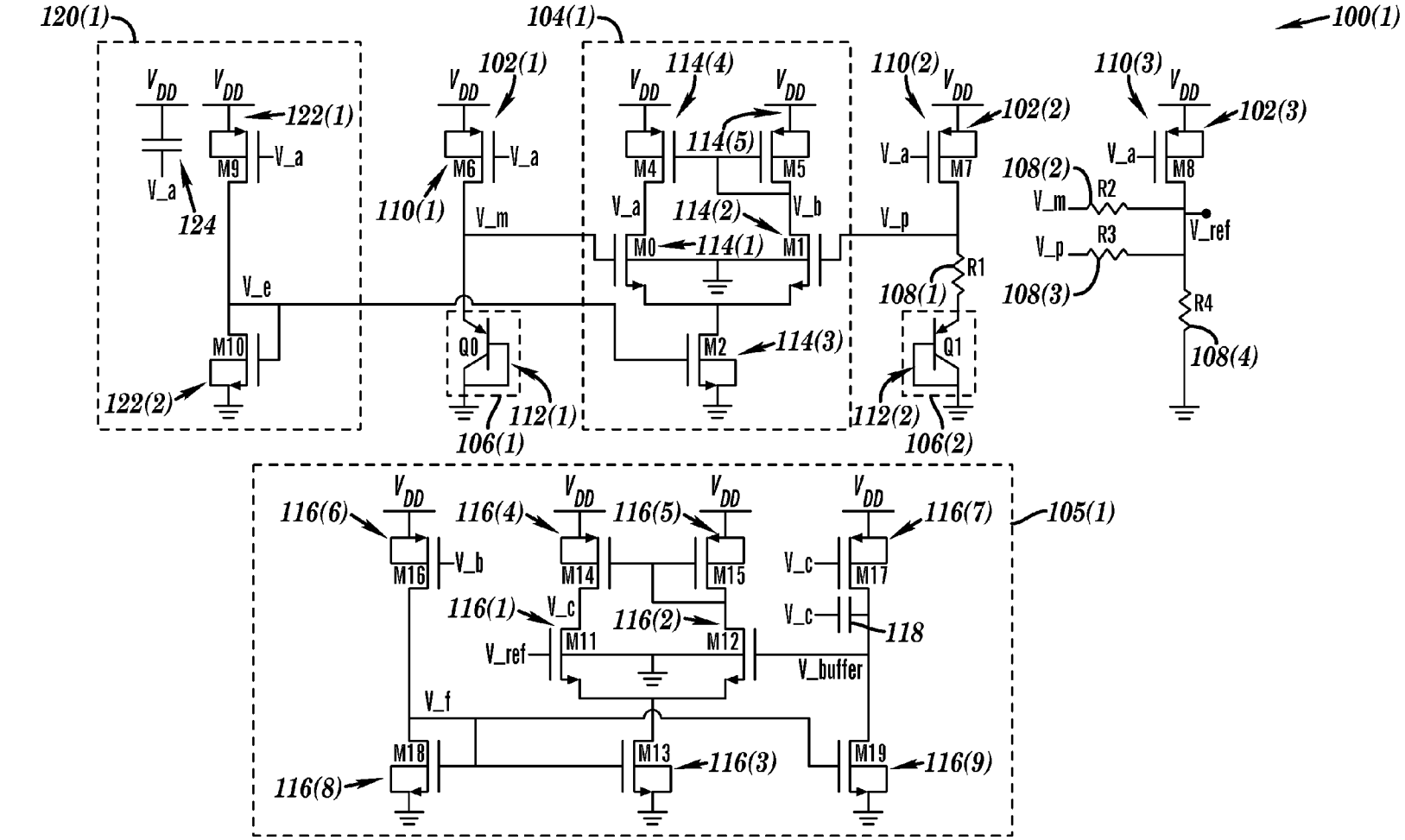
FIG. 2 is a more detailed circuit diagram of the exemplary stable voltage reference circuit with compensation for non-negligible input current shown in FIG. 1.

Referring to FIG. 2, a more detailed circuit diagram of the exemplary stable voltage reference circuit 100(1) with compensation for non-negligible input current is illustrated. The voltage reference circuit 100(1) includes the three current mirrors 102(1)-102(3) comprising field effect transistors 110(1)-110(3) respectively, (also identified as M6, M7, and M8) configured as current mirrors that help form the voltage reference, although other types and numbers of transistors and other types of current mirrors can be used.

More specifically, the three current mirrors 102(1)-102(3) comprise transistors 110(1)-110(3), although the current mirrors can comprise other types and numbers of elements in other configurations. In this example, a source of the transistor 110(1) is coupled to the voltage source $V_{DD}$, a gate of transistor 110(1) is coupled to a terminal V_a and a drain of transistor 110(1) is coupled to an emitter of a transistor 112(1) and a terminal Vm, although other types and numbers of elements in other configurations could be used. Additionally, a source of the transistor 110(2) is coupled to the voltage source $V_{DD}$, a gate of transistor 110(2) is coupled to a terminal V_a, and a drain of transistor 110(2) is coupled to a terminal Vp of operational amplifier 104(1) and a lead of resistor 108(1), although other types and numbers of elements in other configurations could be used. Further, a source of the transistor 110(3) is coupled to the voltage source $V_{DD}$, a gate of transistor 110(3) is coupled to a terminal V_a, and a drain of transistor 110(3) is coupled to a terminal V_ref of voltage buffer 105(1) and a lead of resistor 108(2), a lead of resistor 108(3), a lead of resistor 108(3), and a lead of resistor 108(4), although other types and numbers of elements in other configurations could be used.

The voltage reference circuit 100(1) also includes resistors 108(1)-108(4), although other types and numbers of resistors or other elements could be used. The resistors 108(2)-108(4) are used to minimize some of the negative effects of the input current on the output voltage and to minimize some of the negative effects of the input current temperature coefficient on the output voltage temperature coefficient. If the input current is not compensated, it may result in unexpected output voltage characteristics. These resistors 108(2)-108(4) are used to set the output voltage and temperature coefficient of the output voltage. In addition to the connections noted above, the other lead of resistor 108(1) is coupled to the emitter of transistor 106(2), the other lead of resistor 108(2) is coupled to terminal Vm, the other lead of resistor 108(3) is coupled to terminal Vp, and the other lead of the resistor 108(4) is coupled to ground, although other types and numbers of elements in other configurations could be used.

Figure 8:
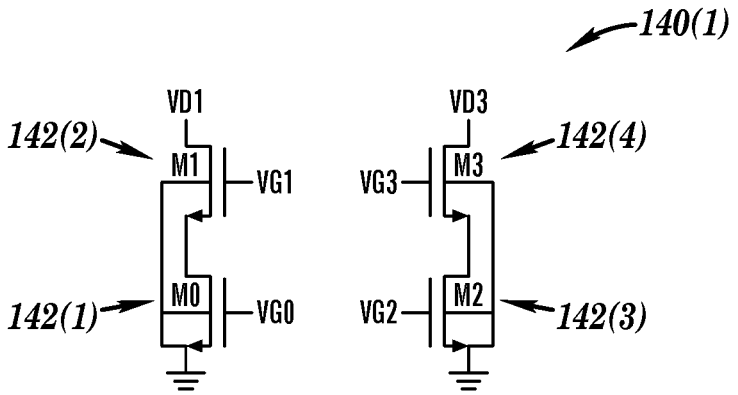
FIG. 8 is a circuit diagram of an optional cascode current mirror circuit to improve the performance of the current mirrors.

In an alternative example, the current mirrors 102(1)-102(2) could function better if they comprised a cascode current mirror circuit 140(1) to balance and compensate for some of the negative effects caused by input current on the output voltage as shown in FIG. 8. The structure 140(1) includes transistors 142(1)-142(4), although the structure can comprise other types and numbers of elements in other configurations. By way of example only, these transistors 142(1)-142(4) could be formed using NMOS, PMOS, PNP, or NPN transistors. The bottom transistor 142(1) (also identified as M0) is sized such that its drain voltage is not significantly altered as the drain voltage of the top transistor 142(2) (also identified as M1) changes. If the gate voltages VG1 and VG2 of transistors 142(1) and 142(3) are similar and changing the drain voltages of transistors 142(2) and 142(4) does not significantly change the drain voltages of transistors 142(1) and 142(3), then transistors 142(1) and 142(3) have similar voltages on their terminals. If this is the case, they should have similar input currents.

In this particular example, the width to length ratio of the transistors 142(2) and 142(4) are each sized to be larger than the width to length ratio of the transistors 142(1) and 142(3), respectively. This is done to minimize the input current in the transistors 142(2) and 142(4), thereby confining the largest contribution to input current to the devices that have a stabilized drain voltage. This cascode current mirror circuit 140(1) can be used for current mirrors or input pairs in a variety of different types of voltage reference circuits, such as the exemplary voltage reference circuits illustrated and described herein with reference to FIGS. 1-6 to the extent necessary to adequately mitigate input currents.

Figure 9:
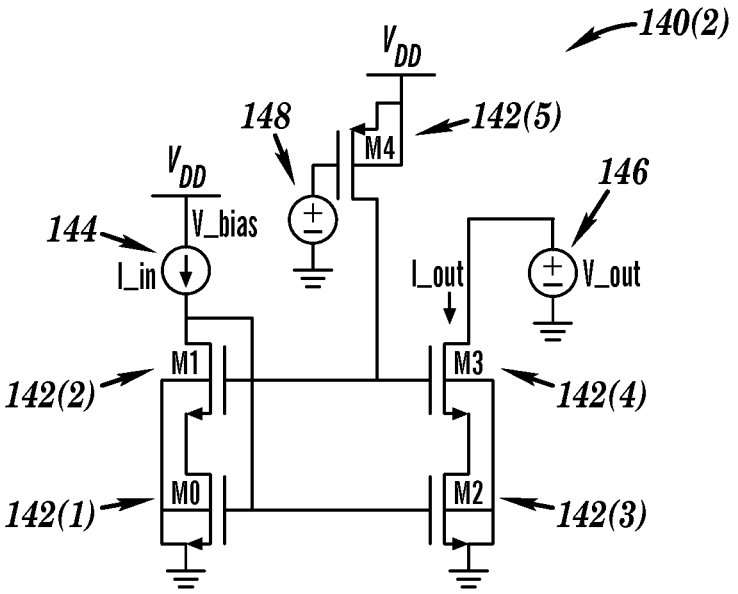
FIG. 9 is a circuit diagram of another optional cascode current mirror circuit to improve the performance of the current mirrors.
Figure 10:
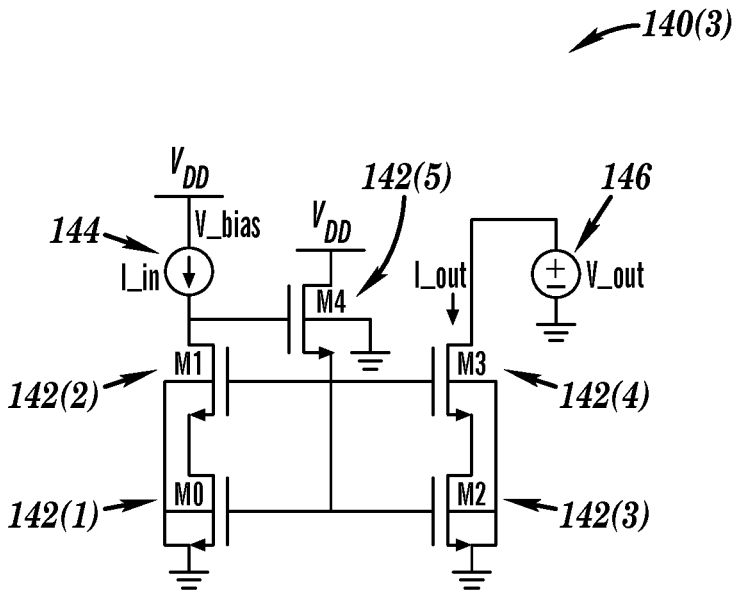
FIG. 10 is a circuit diagram of yet another optional cascode current mirror circuit to improve the performance of the current mirrors.

Other exemplary cascode-like structures 140(2) and 140(3) to improve the performance of the current mirrors are illustrated and described in FIGS. 9 and 10. It is well-known that current mirrors are designed based on the output mirror current (I_out) being a desired multiple of the input mirror current (I_in). When device input current flows, some of the input mirror current is stolen by the device input terminals. This can result in the output mirror current being an undesired multiple of the input current mirror. A solution to this is shown in the exemplary structures 140(2) and 140(3) shown and described with reference to FIGS. 9 and 10 below.

In particular, the exemplary cascode-like structure 140(2) to improve performance of the current mirrors is illustrated in FIG. 9. In this structure 140(2) the transistors 142(1)-142(5) are also identified as M0, M1, M2, M3, and M4. Input mirror current 144 (also identified as I_in) is coupled between the voltage source $V_{DD}$ and the drain of transistor 142(2) and the gates of transistors 142(1)-142(4). The source of transistor 142(2) is coupled to the drain of transistor 142(1) and the source of transistor 142(1) is coupled to ground. Output mirror current 144 (also identified as I_out) is coupled between ground and the drain of transistor 142(4). The source of transistor 142(4) is coupled to the drain of transistor 142(3) and the source of transistor 142(3) is coupled to ground. Input current could flow in each of these transistors 142(1)-142(4).

Transistor 142(5) (also identified as M4) is the additional transistor responsible for supplying some of this input current to these transistors 142(1)-142(4). A source of transistor 142(5) is coupled to the voltage source $V_{DD}$. The drain of transistor 142(5) is coupled to the gates of transistors 142(1)-142(4). A bias voltage 148 (also identified as V_bias) is between the gate of transistor 142(5) and ground. The bias voltage V_bias, and the size of transistor 142(5) are chosen to supply the desired amount of input current.

In one example, the output voltage, V_out and the size of transistor 142(5) could be adjusted until the desired output mirror current (I_out) to input mirror current (I_in) ratio is obtained. The input current of transistor 142(5) could be minimized by adjusting its size. This could be done to ensure that the input current of transistor 142(5) does not impact the performance of the current mirror.

Another exemplary cascode-like structure 140(3) to improve performance of the current mirrors is illustrated in FIG. 10. In this structure, the transistors 142(1)-142(5) are also identified as M0, M1, M2, M3, and M4. Input mirror current 144 (also identified as I_in) is coupled between the voltage source $V_{DD}$ and the drain of transistor 142(2) and the gate of transistors 142(5). The source of transistor 142(2) is coupled to the drain of transistor 142(1) and the source of transistor 142(1) is coupled to ground. Output mirror current 144 (also identified as I_out) is coupled between ground and the drain of transistor 142(4). The source of transistor 142(4) is coupled to the drain of transistor 142(3) and the source of transistor 142(3) is coupled to ground. The drain of transistor 142(5) is coupled to the voltage source $V_{DD}$ and the source of transistor 142(5) is coupled to the gates of transistors 142(1)-142(4). Input current can flow in each of these transistors 142(1)-142(4). Transistor 142(5) is the additional transistor responsible for supplying some of this input current to these transistors.

If transistor 142(5) is sized to minimize its input current, then the current flowing out of its drain terminal is similar to the current flowing into its source terminal, which is then similar to the input currents of transistors 142(1)-142(4). Thus, transistor 142(5) is able to supply some of the input current to transistors 142(1)-142(4) which allows the desired input mirror current to flow into the drain of transistor 142(1) which could possibly help achieve a desired ration between the input current and the output current.

Referring back to FIG. 2, the voltage reference circuit 100(1) also includes two diodes 106(1)-106(2) comprising PNP bipolar transistors 112(1)-112(2), respectively, which are configured as diodes, although other types and numbers of diodes could be used. In this example, the emitter of the transistor 112(1) is coupled to the drain of the transistor 110(1) and a base and collector of the transistor 112(1) are coupled to ground. Additionally, the emitter of the transistor 112(2) is coupled to the other lead of resistor 108(1) and a base and collector of the transistor 112(2) are coupled to ground. The transistors 112(1)-112(2) connected as diodes 106(1) and 106(2) can be used to allow the voltage reference circuits to operate under similar voltage conditions which helps balance the effects of non-negligible input current.

Additionally, the voltage reference circuit 100(1) includes the operational amplifier 104(1) which in this example comprises field effect transistors 114(1)-114(5) (also identified as M0, M1, M2, M4, and M5, respectively), although other numbers and types of elements in other configurations could be used. The source of each of the transistors 114(4)-114(5) are coupled to the voltage source $V_{DD}$ and the gate of each of the transistors 114(4)-114(5) are coupled together, to drains of transistors 114(2) and 114(5) and to a terminal $V_b$. The drain of the transistor 114(4) is coupled to the drain of the transistor 114(1) and the drain of transistor 114(5) is coupled to the drain of the transistor 114(2). The gate of transistor 114(1) is coupled to terminal Vm and the gate of transistor 114(2) is coupled to terminal V_p and the sources of transistors 114(1) and 114(2) are coupled together and to the drain of transistor 114(3). Additionally, the body terminal of transistor 114(1) and the body terminal of transistor 114(2) are coupled together and to ground. The gate of transistor 114(3) is coupled to terminal V_e and the source of the transistor 114(3) is coupled to ground.

Further, the voltage reference circuit 100(1) includes the voltage buffer 105(1) which in this example comprises field effect transistors 116(1)-116(9) (also identified as M11, M12, M13, M14, M15, M16, M17, M18, and M19, respectively) and capacitor 118, although other numbers and types of elements in other configurations could be used. A gate of transistor 116(1) is coupled to terminal Vref and a gate of transistor 116(2) is coupled to terminal Vbuffer. A body terminal of transistor 116(1) is coupled together with a body terminal of transistor 116(2) and to ground. A source of transistor 116(1) is coupled together with a source of transistor 116(2) and to a drain of transistor 116(3). A drain of transistor 116(1) is coupled to a drain of transistor 116(4) and a drain of transistor 116(2) is coupled to a drain of transistor 116(5). A gate of transistor 116(4) is coupled to a gate of transistor 116(5) and to the drains of transistors 116(2) and 116(5). A source of transistor 116(4), a source of transistor 116(5), a source of transistor 116(6) and a source of transistor 116(7) are coupled to the voltage source $V_{DD}$. A gate of transistor 116(6) is coupled to terminal V_b and a gate of transistor 116(7) is coupled to terminal V_c. A drain of transistor 116(6) is coupled to a drain of transistor 116(8), terminal V_f, and gates of transistors 116(3), 116(8), and 116(9). A drain of transistor 116(7) is coupled to a drain of transistor 116(9) and a gate of transistor 116(2). The sources of transistors 116(3), 116(8) and 116(9) are each coupled to ground. A compensation capacitor 118 is coupled between a terminal V_c and the drains of transistors 116(7) and 116(9) and the gate of transistor 116(2). The compensation capacitor 118 is used to compensate the voltage buffer 105(1) comprising transistors 116(1)-116(9). The voltage reference circuit 100(1) also includes a biasing circuit 120(1) which in this example comprises field effect transistors 122(1) and 122(2) (also identified as M9 and M10, respectively) and an optional compensation capacitor 124, although the biasing circuit could comprise other numbers and types of elements in other configurations. The field effect transistors 122(1) and 122(2) are configured as current mirrors that help bias transistor 114(2) of the operational amplifier 104(1) comprising transistors 114(1)-114(5). A source of transistor 122(1) is coupled to the voltage source $V_{DD}$ and the gate of the transistor 122(1) is coupled to terminal $V_a$. The drains of transistors 122(1) and 122(2) are coupled together and to the gate of transistor 114(3) and to the gate of transistor 122(2). The source of transistor 122(2) is coupled to ground and the capacitor 124 is coupled between voltage source $V_{DD}$ and V_a.

Another aspect of examples of this technology relates to the sizing of transistors in voltage reference circuit 100(1) to minimize some of the negative effects of input current, although this sizing adjustment can be used in other voltage reference circuits. The sizing of transistors is done in such a manner to increase the output current to input current ratio. Typically, output current is a desired current and input current is not a desired current. By increasing this ratio, the negative effects of the input current on the output voltage can be minimized. These negative effects could include non-linear temperature coefficient, amplifier input current, amplifier input offset current, equivalent input current noise, current mirror imbalance, and decreased current matching. This ratio can be obtained by examining the characteristics of the voltage reference circuit 100(1).

In one embodiment, the length of a transistor of the voltage reference circuit 100(1) is chosen based on a voltage that represents a threshold of current conduction. This voltage is called the threshold voltage. At certain lengths, for example small channel lengths, the input current may be extremely low, but other performance metrics, such as, but not limited to, matching and voltage headroom may be poor. At other lengths, for example large channel lengths, the input current may be extremely high causing the voltage reference circuit 100(1) to function in a non-ideal manner and thus creating a current imbalance and a large non-linear temperature coefficient in the output reference voltage. In the middle of this channel length regime, there exists a balance such that the output to input current ratio is high and other performance metrics, such as but not limited to output resistance and power, are as desired.

One specific threshold voltage versus channel length regime is created based on doping profiles, for example, the well known and established halo/pocket implant profile. Note that this is not limited to the halo/pocket implant profile and can be generally applied to any scenario of threshold voltage versus channel length. The device width can then be chosen to meet other requirements. These requirements could include matching, output resistance, and headroom voltages. Note that these techniques may be applied to the extent necessary to minimize some of the negative effects of input current.

An exemplary operation of the stable voltage reference circuit 100(1) with compensation for non-negligible input current will now be described below with reference to FIGS. 1-2.

One of the functions of the three current mirrors 102(1)-102(3) comprising transistors 102(1)-102(3) with the transistors 106(1) and 106(2) connected as diodes is to supply and establish a proportional to absolute temperature (PTAT) current in the voltage reference circuit 100(1), although the current mirrors and diodes may have other types and numbers of functions. The current mirrors also aid in mirroring the CTAT current created across resistor 108(2) and resistor 108(3) into resistor 108(4) and thus the current they mirror is responsible for generating the voltage across resistor 108(4).

The biasing circuit 120(1) includes the transistors 122(1) and 122(2) which are configured as current mirrors that help bias transistor 114(3) of the operational amplifier 104(1). The capacitor 124 helps to compensate the operation amplifier 104(1) comprising transistors 114(1)-114(4). In another alternative, a reversed biased diode could be used as the capacitor 124. The reversed biased diode would not suffer from the negative effects caused by input current, which may be present if a thin-oxide MOSFET gate capacitor were used. The depletion capacitance provided by the reversed biased diode could be used for the capacitor because it does not typically suffer from the effects of input current. Examples of possible other compensation capacitors include metal-insulator-metal capacitors or metal-oxide-metal capacitors.

The operational amplifier 104(1) comprising transistors 114(1)-114(5) functions to force the input terminal voltages to be balanced in order to set the desired PTAT current flowing in the current mirrors 102(1)-102(3). Transistors 114(1)-114(5) also force the desired CTAT current to be flowing through mirrors 102(1)-102(3) and resistors 108(2)-108(3). Another function of transistors 114(1)-114(5) is to force the voltage of the emitter of transistor 106(1) to be similar to the drain voltage of transistor 110(2).

The resistors 108(1)-108(4) are selected and used to tune the effects of input current on the temperature coefficient of the voltage reference and the absolute voltage value of the voltage reference. One function of resistor 108(1) includes helping to establish the PTAT current. Two possible functions of resistors 108(2) and 108(3) include establishing a desired temperature coefficient and allowing a complementary to absolute temperature (CTAT) current to flow at non-nominal temperatures. One responsibility of resistor 108(4) is to establish a nominal output voltage. By way of example, resistance values of resistors 108(1)-108(4) to perform these functions are determined by the desire for a temperature coefficient, although each of the resistors 108(1)-108(4) could have other resistance values. In one example, if a minimal temperature coefficient were desired, resistor 108(1) could be chosen to meet overall power and voltage headroom requirements. Resistor 108(4) could be chosen such that V_ref of voltage reference circuit 100(2) is similar to the emitter voltage of 106(1) at the midpoint of the operating temperature range. Resistors 108(2) and 108(3) would then be chosen such that they provided a CTAT current which ideally cancels with the contributing PTAT current flowing through resistor 108(1) and also ideally cancels with the contributing CTAT or PTAT input current that flows in transistors 114(1) and 114(2). The CTAT current flowing in resistors 108(2) and 108(3) is summed with the PTAT current flowing in resistor 108(1) and the CTAT or PTAT input current flowing in transistors 114(1) and 114(2). This summation current is mirrored into resistor 108(4) by transistors 102(1)-102(3) such that, with the contributions of the current through resistors 108(2) and 108(3), the temperature coefficient of the voltage developed across resistor 108(4) is minimized and buffered to produce a desired voltage reference.

The voltage buffer 105(1) may have input current flowing in its non-inverting and inverting input terminals (also labeled as V_ref and V_buffer) and is used to assist with compensating for non-negligible or non-zero device input currents. More specifically, in this example in the voltage buffer 105(1) the input transistors are transistors 116(1) and 116(2) in which input current could flow. These transistors 116(1) and 116(2) can be used to force the input current flowing out of transistor 102(3) to flow into transistor 116(1). This results in the desired current flowing into resistor 108(4).

One example of how this technique can be applied is if the voltage V_ref is similar to the forward bias voltage of a diode. If this is the case, then the current flowing through resistors 108(2) and 108(3) is negligible. If transistors 114(1), 114(2), 116(1) and 116(2) are sized similarly and transistor 114(3) and transistor 116(3) are biased such that they have similar currents flowing in them, then at some nominal temperature the input flowing into transistor 114(1) and transistor 116(1) is similar to the input current flowing in transistor s 114(2) and 116(2). This results in a balance in the voltage reference circuit 100(1) at some nominal temperature because the negative effects of the input current on the current mirrors is minimized and the input current on the input transistors 114(1), 114(2), 116(1), and 116(2) minimally impacts the voltage generated across resistor 108(4). This voltage is the reference voltage V_ref and is copied to the output of the buffer V_buffer.

In another example, the terminal or node V_a drives four gate terminals for transistors 102(1)-102(3) and 122(1) and terminal or node V_b drives three gate terminals 114(4), 114(5), and 116(6). Note in this example, transistor 116(6) is sized to be a multiple of transistors 114(4) and 114(5). For example, transistor 116(6) could be twice the size of transistors 114(4) and 144(5). If transistors 114(4), 114(5), 110(1)-110(3), and 122(1) are sized similarly then similar input current flows through them allowing the operational amplifier 104(1) formed by transistors 114(1)-114(5) to remain balanced.

This technique is also applied to nodes V_e and V_f. In this example, terminal or node V_e drives two gate terminals of transistors 114(3) and 122(2) and terminal or node V_f drives three gate terminals of transistors 116(3) 116(8), and 116(9). If the current supplied by the source terminal of transistor 116(6) is a multiple of transistor 122(1), then the gate areas of transistors 116(3) 116(8), and 116(9) would have to be similar to the gate areas of transistors 114(3) and 122(2) in order to keep current balance.

In one example, the current from transistor 116(6) is twice that of transistor 122(1) and the input current of transistors 114(3), 116(3), 116(8), and 116(9) is twice that of transistor 122(2). In this case, transistor 122(1) supplies one drain current to transistor 122(2) and three input currents. Transistor 116(6) supplies two drain currents to transistor 116(8) and three input currents. In this simple example, the voltages at nodes V_e and V_f are balanced and the currents are desired ratios of one another.

This technique is also applied to transistors 116(4), 116(5), and 116(7). The source terminal of transistor 116(5) drives the gate terminal of transistors 116(4) and 116(5) to form a current load. The drain terminal of transistor 116(4) drives the gate terminal of transistor 116(7). The gate terminal of transistor 116(7) is sized as a multiple of transistors 116(4) and 116(5) in order to balance the input current flowing in the drain terminal of transistor 116(1) with the input current flowing in the drain terminal of transistor 116(2). In one example, the gate area of transistor 116(7) may be twice that of transistors 116(4) and 116(5).

Figure 3:
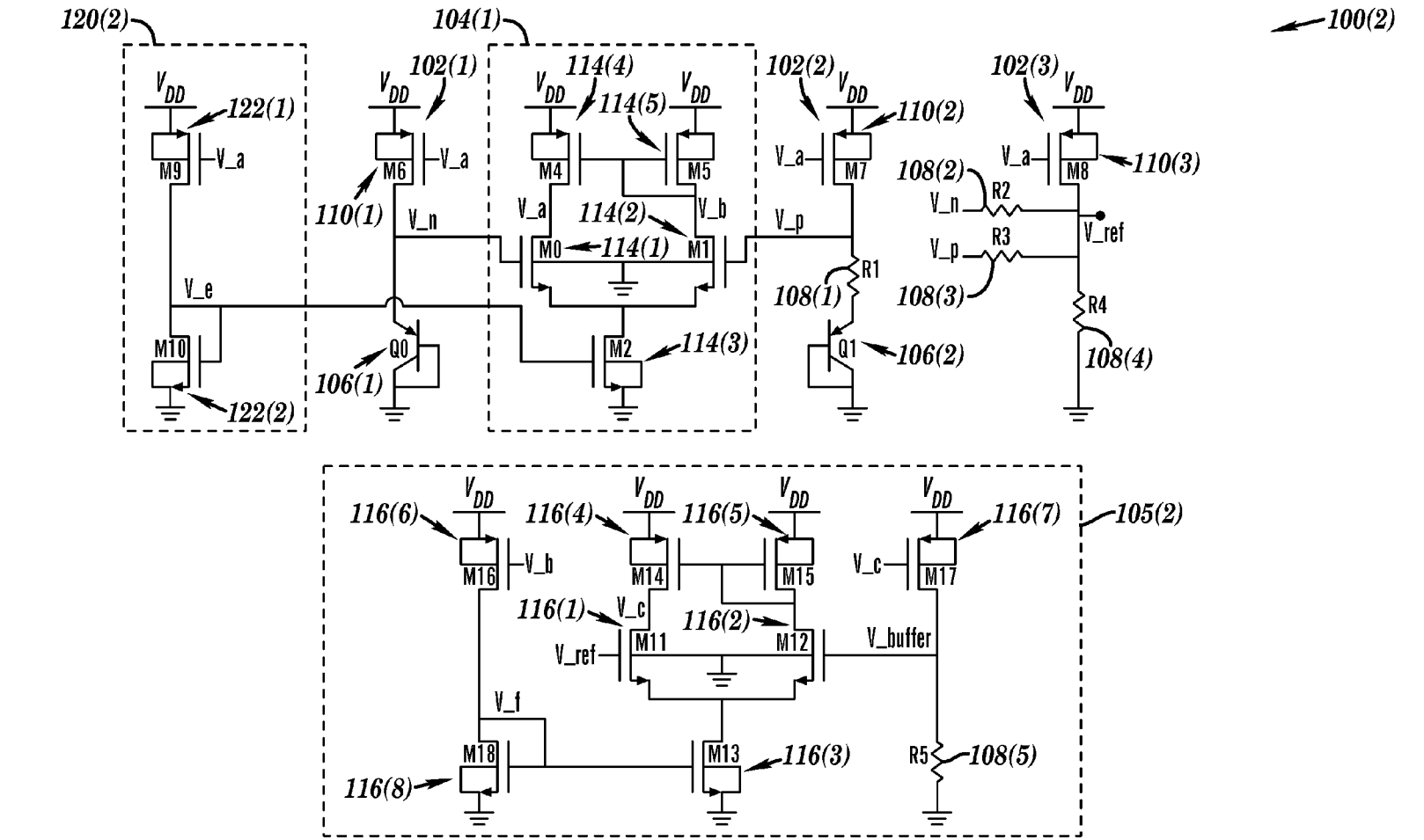
FIG. 3 is a circuit diagram of another exemplary stable voltage reference circuit with an alternative voltage buffer and biasing circuit.

Referring to FIG. 3, another exemplary stable voltage reference circuit 100(2) with an alternative voltage buffer 105(2) and a biasing circuit 120(2) is illustrated. The voltage reference circuit 100(2) is the same in structure and operation as the voltage reference circuit 100(1), except as illustrated and described herein. Elements in voltage reference circuit 100(2) which are like those in voltage reference circuit 100(1) have like reference numerals.

In another exemplary stable voltage reference circuit 100(2), the voltage buffer 105(2) comprises field effect transistors 116(1)-116(8) (also identified as M11, M12, M13, M14, M15, M16, M17, and M18, respectively) and resistor 108(5) and does not include compensation capacitor 118. By way of example only, the compensation used in voltage reference circuit 100(1) could be applied to this voltage reference circuit 100(2). In this example, the drain of transistor 116(6) is coupled to the drain of transistor 116(8), terminal V_f, and gates of transistors 116(3) and 116(8). A drain of transistor 116(7) is coupled to the gate of transistor 116(2) and one lead of a resistor 108(5) (also identified as R5). The sources of transistors 116(3) and 116(8) and the other lead of the resistor 108(5) are each coupled to ground. The resistor 108(5) is sized to give similar output impedance to the V_ref node. By way of example only, if the current flowing out of transistor 116(7) is a multiple of transistor 110(3), such as two, then resistor 108(5) could be made a multiple of resistor 108(4), such as half the value of resistor 108(4), in order to make V_buffer similar to V_ref. Additionally, the biasing circuit 120(2) does not include the optional capacitor 124 shown in FIG. 2.

An exemplary operation of the stable voltage reference circuit 100(2) with compensation for non-negligible input current will now be described below with reference to FIG. 3. The operation of voltage reference circuit 100(2) is the same as the operation of voltage reference circuit 100(1) except as illustrated and described herein.

The difference between voltage reference circuit 100(1) and voltage reference circuit 100(2) is that voltage reference circuit 100(2) contains resistor 108(5) and voltage reference circuit 100(1) contains transistor 116(9). Which exemplary voltage reference circuit is used depends on transistor output impedance, voltage headroom, and power requirements for the particular application. For example, if the output impedance of transistor 116(9) is small, it's threshold voltage is high, or the supply voltage is small, the architecture shown in voltage reference circuit 100(2) may provide superior performance compared to voltage reference circuit 100(1).

Figure 4:
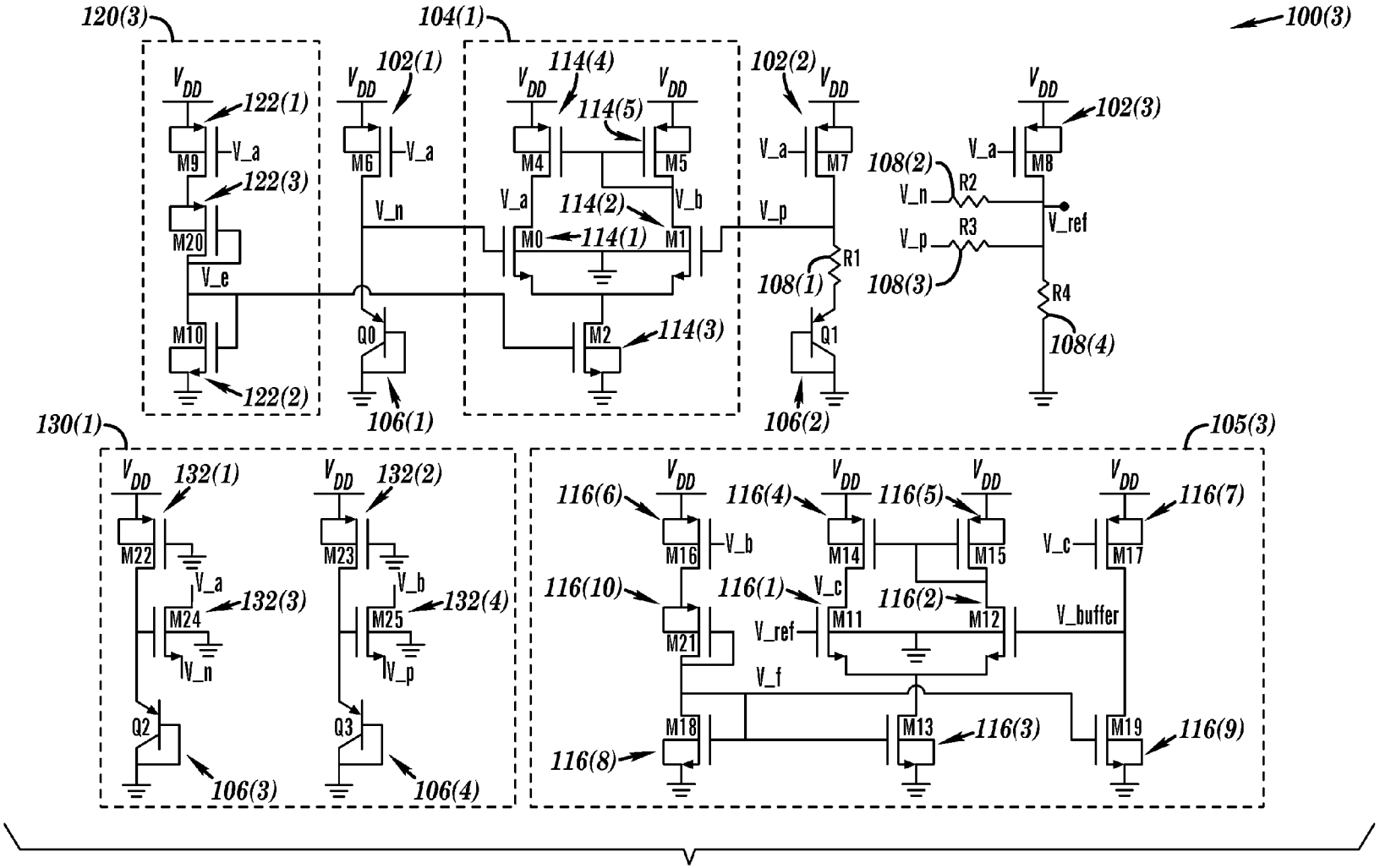
FIG. 4 is a circuit diagram of another exemplary stable voltage reference circuit with a startup circuit and another alternative voltage buffer and biasing circuit.

Referring to FIG. 4, another exemplary stable voltage reference circuit 100(3) with a startup circuit 130 and an alternative voltage buffer 105(3) and biasing circuit 120(3) is illustrated. The voltage reference circuit 100(3) is the same in structure and operation as the voltage reference circuit 100(1), except as illustrated and described herein. Elements in voltage reference circuit 100(3) which are like those in voltage reference circuit 100(1) have like reference numerals.

In this example, the startup circuit 130 is designed to help account for and minimize the effects of input current on the voltage reference circuit 100(3). In this example, the startup circuit 130 comprises field effect transistors 132(1)-132(4) (also identified as M22, M23, M24, and M25, respectively) and bipolar transistors 106(3)-106(4), although other types and numbers of elements in other configurations could be used. The sources of transistors 132(1) and 132(2) are coupled to voltage source $V_{DD}$ and the gates of transistors 132(1) and 132(2) are coupled to ground. The drain of transistor 132(2) is coupled to the gate of transistor 132(4) and to the emitter of transistor 106(4) which is configured as a diode. The drain of transistor 132(4) is coupled to terminal V_b and the source of transistor 132(4) is coupled to V_p. The base of transistor 106(4) is coupled to the collector of transistor 106(4) and to ground. The drain of transistor 132(1) is coupled to the gate of transistor 132(3) and to the emitter of transistor 106(3) which also is configured as a diode. The drain of transistor 132(3) is coupled to terminal V_a and the source of transistor 132(3) is coupled to V_n. The base of transistor 106(3) is coupled to the collector of transistor 106(3) and to ground.

Additionally, in this example the voltage buffer 105(3) is the same as the voltage buffer 105(1), except there is no capacitor 118 and an additional field effect transistor 116(10) (also identified as M21) is coupled between transistors 116(6) and 116(8). By way of example only the capacitor compensation shown in voltage reference circuit 100(1) could be used. In particular, a source of transistor 116(10) is coupled to the drain of transistor 116(4) and a gate and a drain of transistor 116(10) are coupled together and to the drain of transistor 116(8).

Diode connected transistors 122(3) and 116(10) force transistors 122(1) and 116(6) to have similar drain voltages to that of transistors 114(4), 114(5) and 102(1)-102(3). Typically, these transistors also have similar gate voltages and source voltages, thus their input currents are similar. This helps balance the current mirrors 102(1)-102(3) of the voltage reference circuit 102(3). These diode connected transistors 122(3) and 116(10) are not always required and are typically added if the drain voltage has a noticeable impact on the input current. Although these diode connected transistors 122(3) and 116(10) are illustrated and described in voltage reference circuit 100(3), they can be used anywhere in order to make voltage conditions similar and in other voltage reference circuits, such as voltage reference circuits 100(4) and 100(5) shown in FIGS. 5 and 6 by way of example only. This modification may be particularly beneficial where the drain/collector voltage of a MOSFET or BJT has a significant impact on the device input current.

An exemplary operation of the stable voltage reference circuit 100(3) with compensation for non-negligible input current will now be described below with reference to FIG. 4. The operation of voltage reference circuit 100(3) is the same as the operation of voltage reference circuit 100(1) except as illustrated and described herein. Although the startup circuit 130 is shown with the voltage reference circuit 100(3), the startup circuit can be used, but does not have to be used, with other voltage reference circuits, such as voltage reference circuits 100(1), 100(2), and 100(4)-100(7) by way of example only.

It is well known that voltage reference circuits have two possible starting conditions: a first condition is the ideal condition in which the voltage reference circuit functions correctly; and a second condition is the non-ideal condition which occurs when atypical current flows through the voltage reference circuit. In the non-ideal condition, the voltage reference circuit does not function as desired.

In this example, the startup circuit 130 is designed to force voltage reference circuit 100(3) into the ideal condition. In the non-ideal condition, the gate voltages of transistors 132(3) and 132(4) are larger than the source voltages of transistors 132(3) and 132(4). This causes the transistors 132(3) and 132(4) to begin conducting. If these transistors 132(3) and 132(4) are conducting, then current is flowing out of their source terminals. This current from the source terminals of transistors 132(3) and 132(4) is fed directly into diode connected transistors 106(1) and 106(2) via terminal V_n and V_p. As current flows into transistors 106(1) and 106(2), their emitter voltages rise and thus transistors 114(1) and 114(2) begin to conduct. The conduction of transistors 114(1) and 114(2) force their gate voltages to rise, turns off transistors 132(3) and 132(4), and puts the voltage reference circuit 100(3) in the ideal operating condition.

The negative effects of input current are minimized because the gate and source voltages of transistors 132(3) and 132(4) are designed to be the emitter voltages of a diode connected transistors 106(1)-106(4). Thus, when the reference is in its ideal condition, these voltages change similarly over temperature and are similar in absolute value. This reduces the impact of input current because the gate to source voltages of transistors 132(3) and 132(4) are minimized. The impact of input current is balanced because the input current flowing in transistor 132(3) is similar to that flowing in transistor 132(4) because they have similar sizes and voltages on their terminals. In an alternative example, the startup circuit 130 also can be made to work if the source terminal of transistor 132(3) is connected to V-ref and the source terminal of transistor 132(4) is connected to V_buffer.

Additionally, the addition of the transistor 116(10) configured as a diode in voltage buffer 105(3) of voltage reference circuit 100(3) enables to be potentially be less susceptible to the impact of difference between transistor terminal voltages than the architecture shown in voltage reference circuit 100(1). If the difference in drain voltages between transistor terminals creates significant differences in input current between devices that are designed to have similar input current, one function of transistor 116(10) is to minimize these differences.

Figure 5:
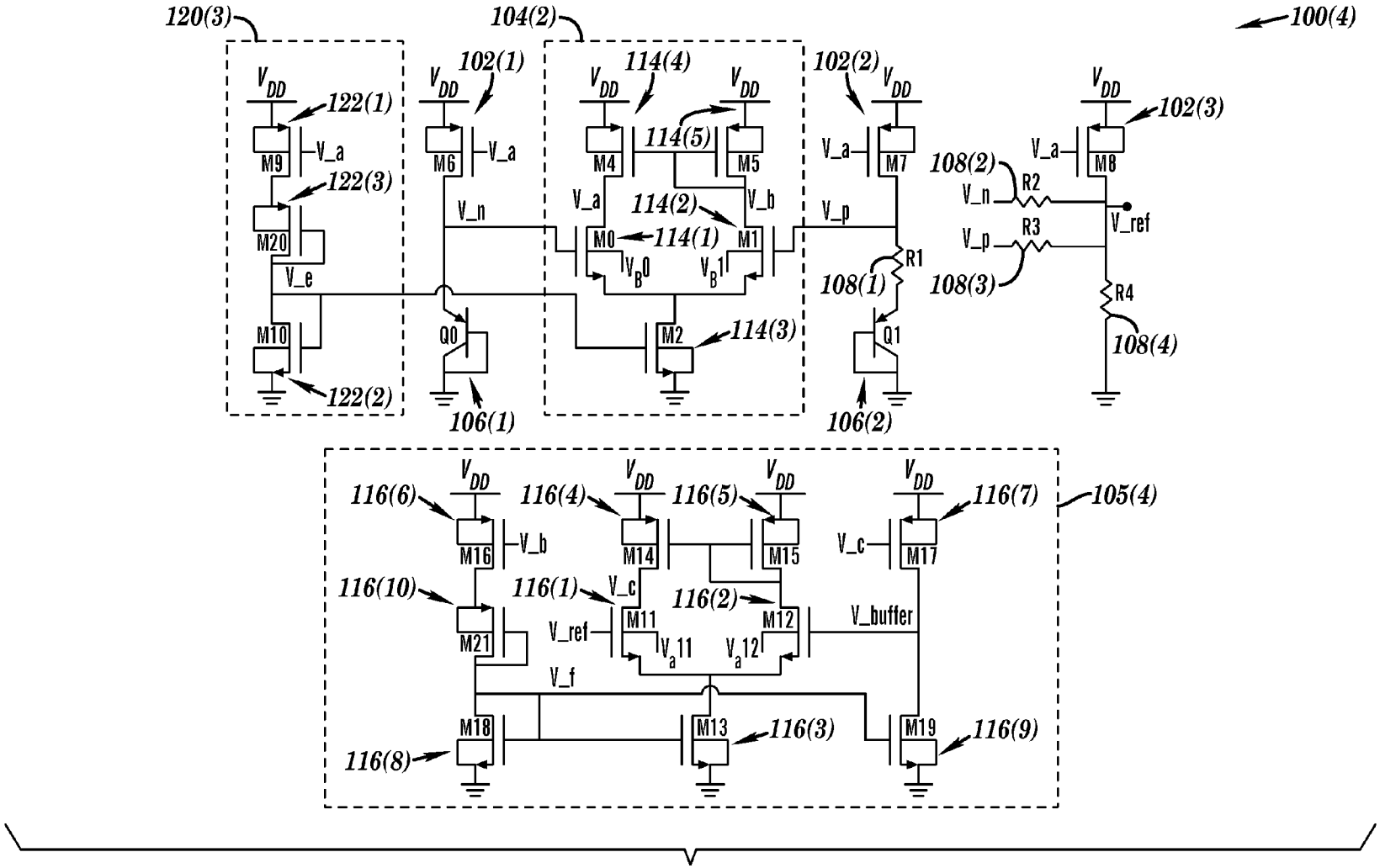
FIG. 5 is a circuit diagram of an exemplary stable voltage reference circuit with another alternative operational amplifier and voltage buffer.

Referring to FIG. 5, another exemplary stable voltage reference circuit 100(5) with an alternative operational amplifier 104(2) and voltage buffer 105(4). The voltage reference circuit 100(4) is the same in structure and operation as the voltage reference circuit 100(3), except as illustrated and described herein. Elements in voltage reference circuit 100(4) which are like those in voltage reference circuit 100(3) have like reference numerals.

In this example, the starter circuit 130 could be used, but is not illustrated. The operational amplifier 104(2) is the same as the operational amplifier 104(1), except the body terminal of transistor 114(1) is not coupled to the body terminal of transistor 114(2) and to ground. Instead, the body terminal of transistor 114(1) is coupled to terminal or node $V_{B0}$ and the body terminal of transistor 114(2) is coupled to terminal or node $V_{B1}$. Additionally, the voltage buffer 105(4) is the same as the voltage buffer 105(3), except the body terminal of transistor 116(1) is not coupled to the body terminal of transistor 116(2) and to ground. Instead, the body terminal of transistor 116(1) is coupled to terminal or node $V_{B11}$ and the body terminal of transistor 116(2) is coupled to terminal or node $V_{B12}$.

The use of the body terminals of transistors 114(1) and 114(2) as illustrated and described herein for the voltage reference circuits 100(1)-100(7), by way of example only, helps to reduce the negative effects of input current. It is well known that the body voltage of a MOSFET can have significant impact on the voltage across the oxide of a MOSFET and the threshold voltage of a MOSFET. It is also well known that the voltage across the oxide can significantly impact the input current. Therefore, applying a voltage to the body terminal of a MOSFET can possibly reduce the negative effects of input current. An illustrative example is shown in FIG. 5, where bias voltages can be applied to transistors 114(1), 114(2), 116(1), and 116(2). Note that these voltages could be positive or negative. In one example, the body terminals of these transistors 114(1), 114(2), 116(1), and 116(2) could be connected directly to their source terminals. In another example, the body terminals of these transistors 114(1), 114(2), 116(1), and 116(2) could be connected to their gate terminals. In yet another example, the body voltages of these transistors 114(1), 114(2), 116(1), and 116(2) could generated by a current mirror leg like the one shown in FIG. 6. This technique could be applied to any of the transistors in the exemplary embodiments illustrated and described herein.

An exemplary operation of the stable voltage reference circuit 100(4) with compensation for non-negligible input current will now be described below with reference to FIG. 5. The operation of voltage reference circuit 100(4) is the same as the operation of voltage reference circuit 100(3) except as illustrated and described herein.

If you supply a voltage to the body terminal of transistors 114(1), 114(2), 116(1), and 116(2), you may not need to adjust resistors 108(2) and 108(3) as much for the effects of input current compared to if you hard-tied the body voltages of transistors 114(1), 114(2), 116(1), and 116(2) to ground. One example would be tying the body terminals of transistors 114(1), 114(2), 116(1), and 116(2) to their source terminals.

Figure 6:
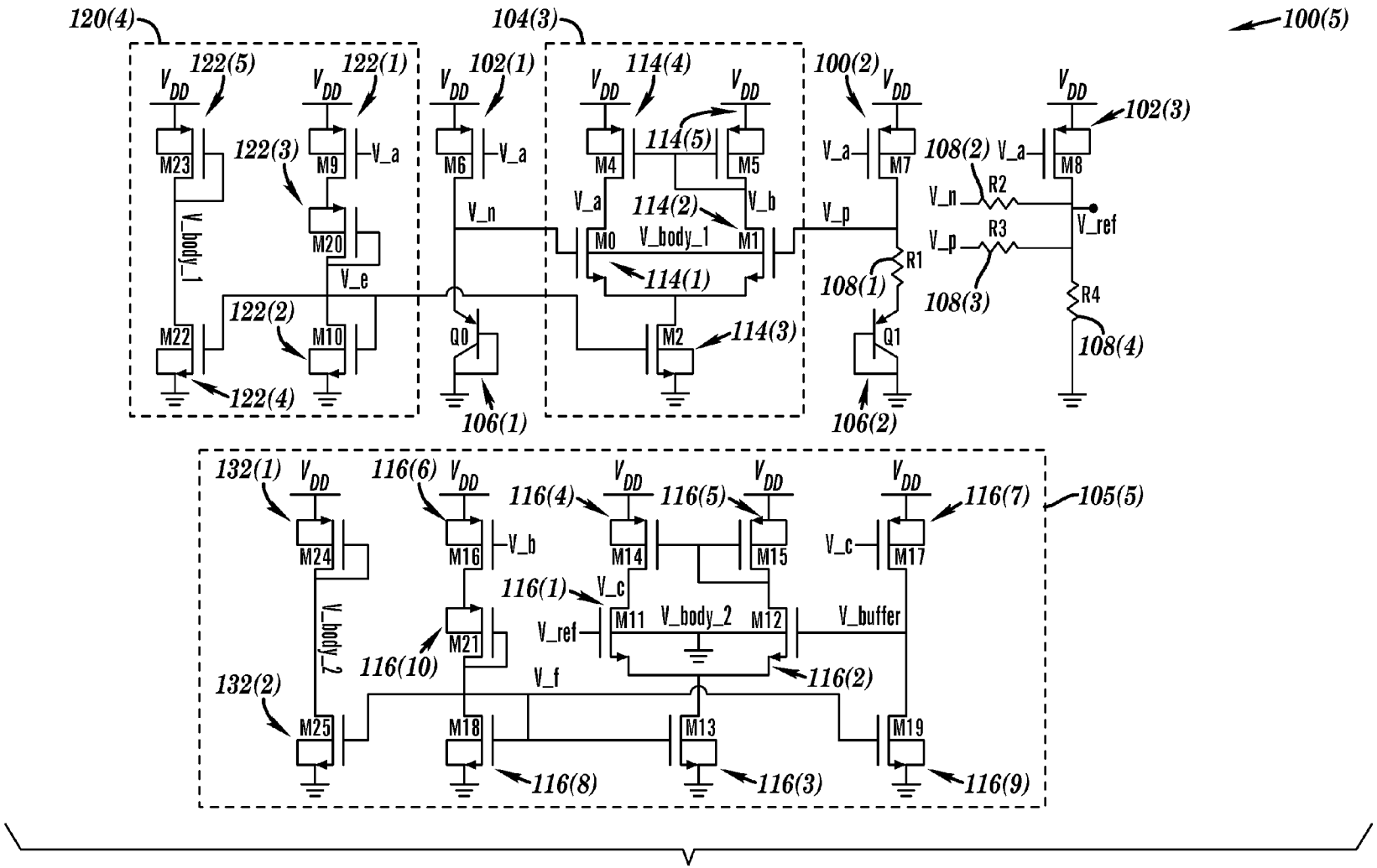
FIG. 6 is a circuit diagram of an exemplary stable voltage reference circuit with another alternative operational amplifier, voltage buffer and biasing circuit.

Referring to FIG. 6, another exemplary stable voltage reference circuit 100(5) with an alternative operational amplifier 104(3), voltage buffer 105(5), and biasing circuit 120(4) is illustrated. The voltage reference circuit 100(5) is the same in structure and operation as the voltage reference circuit 100(4), except as illustrated and described herein. Elements in voltage reference circuit 100(5) which are like those in voltage reference circuit 100(4) have like reference numerals.

In this example, the operational amplifier 104(3) is the same as the operational amplifier 104(2), except the body terminal of transistor 114(1) is not coupled to the body terminal of transistor 114(2) and to ground. Instead, the body terminal of transistor 114(1) is coupled to the body terminal of transistor 114(2) and forms a terminal or node V_body_1.

Additionally, the voltage buffer 105(5) is the same as the voltage buffer 105(4), except the body terminal of transistor 116(1) is not coupled to ground or node $V_B$11 and the body terminal of transistor 116(2) is not coupled to ground or node $V_B$12. Instead, the body terminal of transistor 116(1) is coupled to the body terminal of transistor 116(2) and forms a terminal or node V_body_2. Additionally, a source of a transistor 132(1) (also identified as M24) is coupled to a voltage source $V_{DD}$. A gate and a drain of transistor 132(2) are coupled together and to the drain of transistor 132(2) to form a terminal or node V_body_2. Transistor 132(2) is connected as a diode. A gate of transistor 132(2) (also identified as M25) is coupled to a gate of transistors 116(3), 116(8), and 116(9) and a drain of transistor 132(2) is coupled to ground.

Further, the biasing circuit 120(4) is the same as the biasing circuit 120(3), except the biasing circuit 120(4) includes transistors 122(4) and 122(5) (also identified as M23 and M24, respectively). A source of transistor 122(5) is coupled to the voltage source $V_{DD}$. A gate and a drain of transistor 122(5) are coupled together and to the drain of transistor 122(4) to form a terminal or node V_body_1. Transistor 122(5) is connected as a diode. A gate of transistor 122(4) (also identified as M22) is coupled to a gate of transistors 114(3) and 122(2) and a source of transistor 122(4) is coupled to ground An exemplary operation of the stable voltage reference circuit 100(5) with compensation for non-negligible input current will now be described below with reference to FIG. 6. The operation of voltage reference circuit 100(5) is the same as the operation of voltage reference circuit 100(4) except as illustrated and described herein. In this example, V_body_1 and V_body_2 are generated by transistors 122(4), 122(5), 132(1), and 132(2) in order to minimize the input current flowing through transistors 114(1), 114(2), 116(1), and 116(2). V_body_1 and V_body_2 change similarly over temperature such that the effects of input current on transistors 114(1), 114(2), 116(1), and 116(2) are minimized over a wide temperature range. Voltage reference circuit 100(5) provides a way of generating body terminal voltages for transistors 114(1), 114(2), 116(1), and 116(2) through the use of active circuitry instead of hard-tying their body terminals to a fixed supply.

Figure 7:
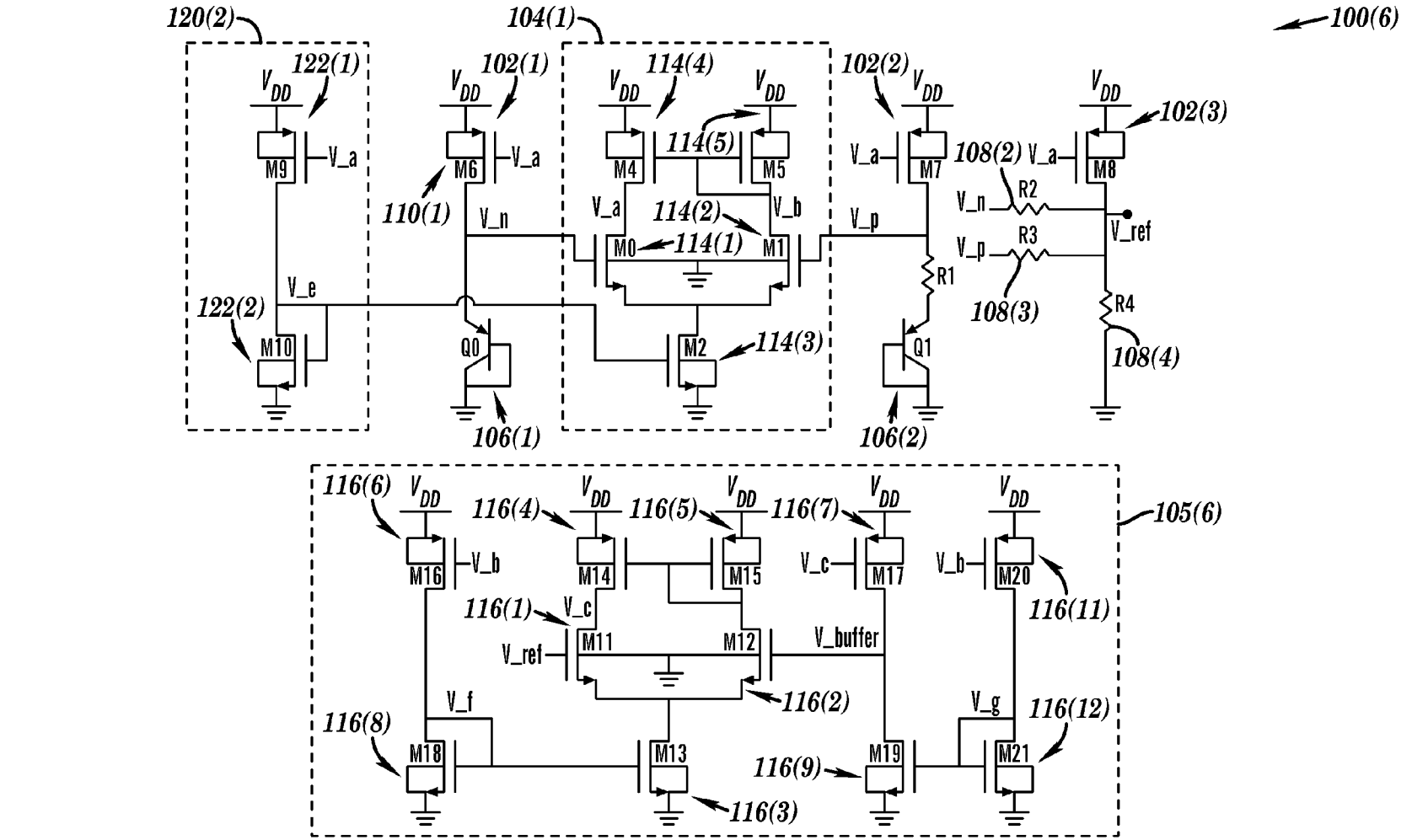
FIG. 7 is a circuit diagram of an exemplary stable voltage reference circuit with another alternative voltage buffer.

Referring to FIG. 7, another exemplary stable voltage reference circuit 100(6) with an alternative voltage buffer 105(6) is illustrated. The voltage reference circuit 100(6) is the same in structure and operation as the voltage reference circuits 100(1) and 100(2), except as illustrated and described herein. Elements in voltage reference circuit 100(6) which are like those in voltage reference circuits 100(1) and 100(2) have like reference numerals.

The biasing circuit 120(2) in FIG. 7 is the same in structure and operation as the biasing circuit 120(2) shown and described with reference to FIG. 3. The voltage buffer 105(6) in FIG. 7 is the same in structure and operation as the voltage buffer 105(1) shown and described with reference to FIG. 1, except the drain of transistor 116(6) is coupled to the drain of transistor 116(8), terminal V_f, and the gates of transistors 116(3) and 116(8), but not the gate of transistor 116(9). Instead the gate of transistor 116(9) is coupled to the drain of transistor 116(11) (also identified as M20) and the gate and drain of transistor 116(12) (also identified as M21). The transistor 116(12) is connected as a diode and the source of transistor 116(12) is coupled to ground. The gate of transistor 116(11) is coupled to terminal or node V_b and the source of transistor 116(11) is coupled to voltage source $V_{DD}$.

An exemplary operation of the stable voltage reference circuit 100(6) with compensation for non-negligible input current will now be described below with reference to FIG. 7. The operation of voltage reference circuit 100(6) is the same as the operation of voltage reference circuit 100(1) except as illustrated and described herein. In this example, the current mirror comprising transistor 116(6) in FIG. 1 now comprises transistors 116(6) and 116(11). additionally, in this example terminals or nodes V_a and V_b can be balanced because each of these nodes drives four gates and these gate areas are similar. This results in current mirrors that have similar sizes, voltages, and currents.

Splitting transistor 116(6) in voltage reference circuit 100(1) into transistors 116(6) and 116(11) as in voltage reference circuit 100(5) may decrease the impact of input of the desired current ratio. For example, in voltage reference circuit 100(1) the transistor 116(6) has to drive the gate terminals of three transistors: 116(8); 116(3); and 116(9). In voltage reference circuit 100(6), the transistor 116(6) drives the gates of two transistors (116(8) and 116(3)), while transistor 116(11) drives the gate of two transistors: 116(12) and 116(9). Having transistors 116(11) and 116(6) in voltage drive circuit 100(6) each drive two transistors may provide less overall current ratio degradation than having transistor 116(6) drive three transistors as in voltage reference circuit 100(1).

Referring to FIG. 3, another exemplary stable voltage reference circuit 100(7) is illustrated. The voltage reference circuit 100(7) is the same in structure and operation as the voltage reference circuit 100(1), except as illustrated and described herein. Elements in voltage reference circuit 100(7) which are like those in voltage reference circuit 100(1) have like reference numerals. In particular, exemplary stable voltage reference circuit 100(7) is identical to voltage reference circuit 100(1), except cascode current mirrors, such as the exemplary ones illustrated and described with reference to FIGS. 8-10 are utilized.

Figure 11:
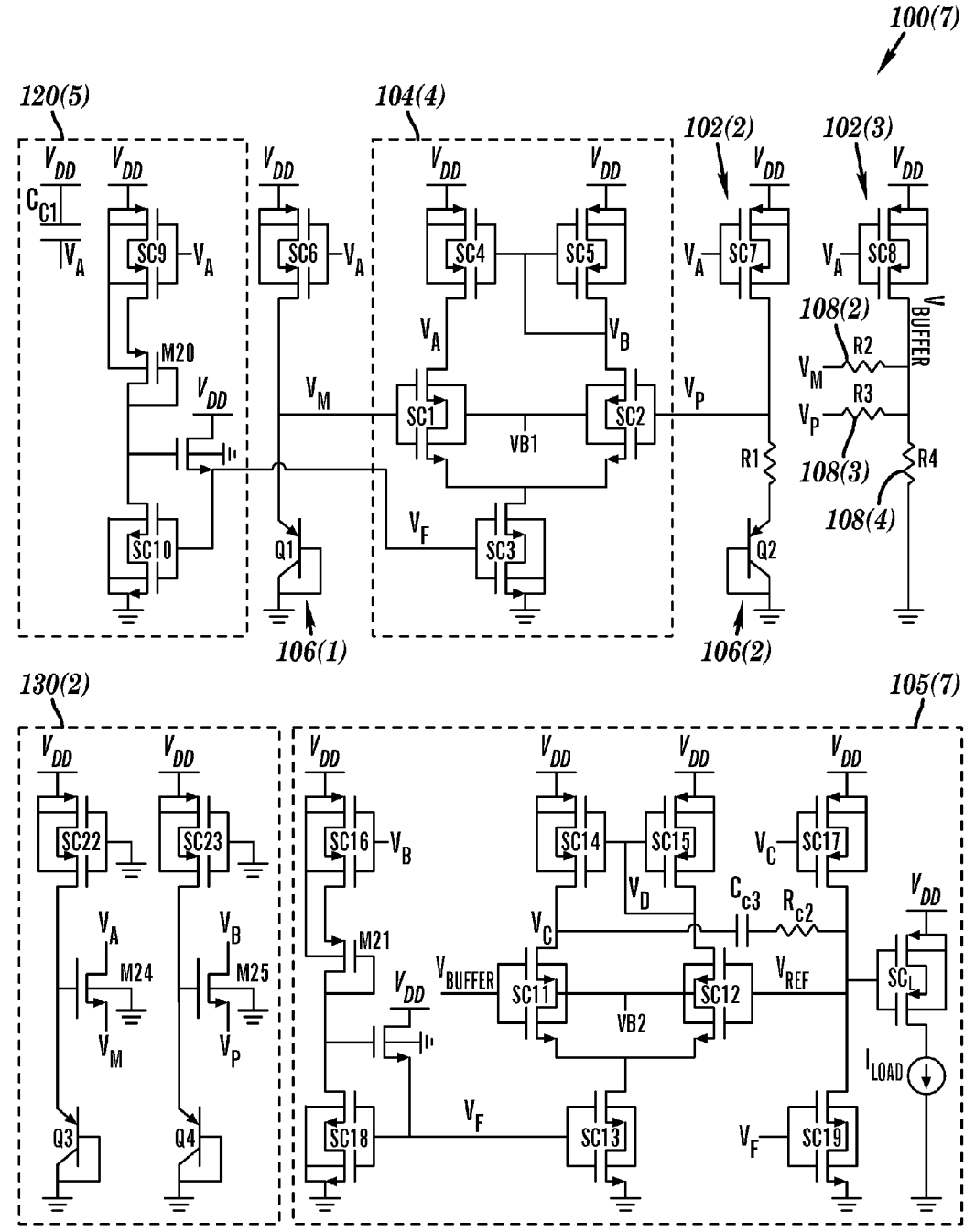
FIG. 11 is a circuit diagram of an exemplary stable voltage reference circuit with cascode current mirrors to improve performance of the reference.

An exemplary operation of the stable voltage reference circuit 100(2) with compensation for non-negligible input current will now be described below with reference to FIG. 11. The operation of voltage reference circuit 100(7) is the same as the operation of voltage reference circuit 100(1)

except with improved performance for the current mirrors through the use of the cascode current mirrors.

Accordingly, as illustrated and described with the examples herein, this technology provides a number of advantages including providing stable voltage reference circuits and methods with compensation for non-negligible input current flowing into or out of input terminals to transistors that could cause imbalance to current mirrors or amplifiers and affect the characteristics of the output voltage. With this technology, input currents are balanced to ensure that the transistors that make up the voltage reference circuit drive similar areas and have similar voltages applied to their terminals. Additionally, with this technology transistors which make up the voltage reference circuit are sized to minimize some of the negative effects of input current. For example, transistor sizing is chosen to balance the output current to input current ratio which is an indicator of the relative effect of input current on the voltage reference.

Having thus described the basic concept of the invention, it will be rather apparent to those skilled in the art that the foregoing detailed disclosure is intended to be presented by way of example only, and is not limiting. Various alterations, improvements, and modifications will occur and are intended to those skilled in the art, though not expressly stated herein. These alterations, improvements, and modifications are intended to be suggested hereby, and are within the spirit and scope of the invention. Additionally, the recited order of processing elements or sequences, or the use of numbers, letters, or other designations therefore, is not intended to limit the claimed processes to any order except as may be specified in the claims. Accordingly, the invention is limited only by the following claims and equivalents thereto.

What is claimed is:

1. A voltage reference circuit comprising:

a bandgap circuit comprising, a closed-loop differential operational amplifier, including a non-inverting input port, an inverting input port and an amplifier output port, the non-inverting input port potential being substantially equal to the inverting input port potential, the differential operational amplifier subject to field emission currents;

a first circuit comprising a first current mirror including a first gate coupled to the amplifier output port, the first gate having an oxide layer sized to be subject to field emission currents, a first input port coupled to a voltage supply and a first output port coupled to the inverting input port, the first circuit also including a first diode structure coupled between the first output port and a ground potential, and a second circuit comprising a second current mirror including a second gate coupled to the amplifier output port, the second gate having an oxide layer sized to be subject to field emission currents, a second input port coupled to the voltage supply, and a second output port coupled to the non-inverting input port, the second circuit also including a first resistor and a second diode structure coupled in series between the second output port and the ground potential such that the first resistor establishes a proportional-to-absolute temperature (PTAT) current characterized by a selected temperature coefficient;

a tuning network coupled to the to the non-inverting input port and the to the inverting input port, the tuning network being configured to provide a complementary-to-absolute temperature (CTAT) current that substantially cancels the selected temperature coefficient;

a third circuit comprising a third current mirror including a third gate coupled to the amplifier output port, the third gate having an oxide layer sized to be subject to field emission currents, the third circuit including a third input port coupled to the voltage supply, the third circuit also including a third output port coupled to the tuning network and a second resistor disposed between the third output port and the ground potential, the second resistor coupled to a voltage reference port that is biased such that the CTAT current and the PTAT current are combined to establish a substantially temperature independent voltage reference signal across the second resistor; and a closed-loop buffer amplifier including at least one buffer input coupled to the third output port and at least one buffer output port, wherein the differential operational amplifier includes at least one operational amplifier input transistor and the input port of the buffer amplifier includes at least one buffer input transistor, the size of the at least one operational amplifier input transistor being substantially matched to the size of the at least one buffer input transistor to substantially reduce the field emission currents propagating in the substantially temperature independent voltage reference signal.

2. The circuit of claim 1, wherein the first current mirror is comprised of at least one first transistor, the second current mirror is comprised of at least one second transistor, and the third current mirror is comprised of at least one third transistor.

3. The circuit of claim 2, wherein the at least one first transistor includes a plurality of first transistors arranged in a cascoded transistor arrangement.

4. The circuit of claim 2, wherein the at least one second transistor includes a plurality of second transistors arranged in a cascoded transistor arrangement.

5. The circuit of claim 2, wherein the at least one third transistor includes a plurality of third transistors arranged in a cascoded transistor arrangement.

6. The circuit of claim 1, wherein the differential operational amplifier includes a plurality of input transistors coupled to a plurality of output transistors, the plurality of input transistors and the plurality of output transistors are sized to substantially reduce the field emission currents propagating in the substantially temperature independent voltage reference signal by establishing a predetermined ratio of output current to input current.

7. The circuit of claim 6, wherein the plurality of input transistors and the plurality of output transistors are sized by establishing at least one transistor width/length ratio.

8. The circuit of claim 1, wherein the size of the at least one operational amplifier input transistor is matched by establishing at least one transistor width/length ratio.

9. The circuit of claim 1, wherein the at least one operational amplifier input transistor includes a first input transistor coupled to the non-inverting input port and a second input transistor coupled to the inverting input port, and wherein the at least one buffer input includes a non-inverting buffer input and an inverting buffer input, the at least one buffer input transistor including a first buffer input transistor coupled to the non-inverting buffer input and a second buffer input transistor coupled to the inverting buffer input, the first input transistor and the second input transistor are matched to the first buffer input transistor and the second buffer input transistor to substantially reduce the field emission currents propagating in the substantially temperature independent voltage reference signal.

10. The circuit of claim 9, wherein the sizes of the transistors are matched by establishing at least one transistor width/length ratio.

11. The circuit of claim 1, further comprising a first biasing circuit for the differential operational amplifier and a second biasing circuit for the buffer amplifier, the first biasing circuit including a first biasing gate coupled to the amplifier output port and a first biasing output coupled to a biasing transistor of the differential operational amplifier, the second biasing circuit including a second biasing gate coupled to an inverted amplifier output port and a second biasing output coupled to a biasing transistor of the buffer amplifier.

12. The circuit of claim 11, wherein the differential operational amplifier includes a plurality of output transistors, the second biasing circuit including a second biasing transistor that is sized relative to the plurality of output transistors to substantially reduce the field emission currents propagating in the substantially temperature independent voltage reference signal.

13. The circuit of claim 12, wherein the plurality of output transistors are sized to be comparable to a size of transistors comprising the first current mirror, the second current mirror or the third current mirror to substantially reduce the field emission currents propagating in the substantially temperature independent voltage reference signal.

14. The circuit of claim 13, wherein the sizes of the transistors are matched by establishing at least one transistor width/length ratio.

15. The circuit of claim 1, wherein the buffer amplifier includes an output circuit including an impedance transformation component configured to transform the impedance of the at least one buffer input to substantially equal the impedance of the third output port.

16. The circuit of claim 1, further comprising a startup circuit coupled to the differential operation amplifier, the startup circuit being configured to drive the differential operation amplifier into a predetermined state.

17. The circuit of claim 1, wherein the tuning network includes at least one resistor.

18. The circuit of claim 1, wherein the tuning network includes a parallel resistor network disposed between the third output port and the differential operational amplifier.

19. The circuit of claim 18, wherein the parallel resistor network including a third resistor coupled between the non-inverting input port and the third output port, and a third resistor coupled between the inverting input port and the third output port.

20. The circuit of claim 1, wherein the substantially temperature independent voltage reference signal is a function of the selected temperature coefficient.

21. The circuit of claim 1, wherein the value of the second resistor is selected such that the substantially temperature independent voltage reference signal is similar to an emitter voltage of the first diode.

22. The circuit of claim 1, wherein the value of the first resistor is selected to minimize the selected temperature coefficient.

23. The circuit of claim 1, wherein the field emission currents include direct tunneling currents, Fowler-Nordheim tunneling currents, or currents propagating because of hot electrons.

* * * * *

UNITED STATES PATENT AND TRADEMARK OFFICE

CERTIFICATE OF CORRECTION

PATENT NO. : 9,310,825 B2
APPLICATION NO. : 12/910556
DATED : April 12, 2016
INVENTOR(S) : Eric Bohannon It is certified that error appears in the above-identified patent and that said Letters Patent is hereby corrected as shown below:

In the Claims
Column 15, line 63: after "a tuning network coupled" delete "to the" (first occurrence)
Column 15, line 64: after "port and" delete "the" (first occurrence)

Signed and Sealed this
Twenty-first Day of June, 2016

Michelle K. Lee

Michelle K. Lee
*Director of the United States Patent and Trademark Office*